US008260158B2

(12) United States Patent
Goto et al.

(10) Patent No.: US 8,260,158 B2
(45) Date of Patent: Sep. 4, 2012

(54) RECORDING SHEET PROCESSING DEVICE

(75) Inventors: Takeshi Goto, Miyagi (JP); Osamu Kitagawa, Miyagi (JP); Fumi Miura, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 343 days.

(21) Appl. No.: 12/656,004

(22) Filed: Jan. 13, 2010

(65) Prior Publication Data

US 2010/0189449 A1 Jul. 29, 2010

(30) Foreign Application Priority Data

Jan. 26, 2009 (JP) ..... 2009-014626

(51) Int. Cl.
*G03G 15/00* (2006.01)

(52) U.S. Cl. ..... 399/20; 399/21; 399/407

(58) Field of Classification Search ..... 399/20, 399/21, 407, 18, 408, 410
See application file for complete search history.

(56) References Cited

U.S. PATENT DOCUMENTS

| | | | | |
|---|---|---|---|---|
| 6,305,681 | B1 | 10/2001 | Watanabe et al. | |
| 6,527,269 | B2 | 3/2003 | Yamada et al. | |
| 7,134,654 | B2 | 11/2006 | Yamada et al. | |
| 7,198,268 | B2 | 4/2007 | Yamada et al. | |
| 7,461,578 | B2 | 12/2008 | Tamura et al. | |
| 2006/0261544 | A1 | 11/2006 | Tamura et al. | |
| 2008/0298867 | A1 * | 12/2008 | Watanabe et al. | 399/407 |
| 2009/0110411 | A1 * | 4/2009 | Gungor et al. | 399/20 |

FOREIGN PATENT DOCUMENTS

| | | |
|---|---|---|
| JP | 09-236957 | 9/1997 |
| JP | 2003-095508 | 4/2003 |
| JP | 2005-343661 | 12/2005 |

* cited by examiner

*Primary Examiner* — Judy Nguyen
*Assistant Examiner* — Blake A Tankersley
(74) *Attorney, Agent, or Firm* — Harness, Dickey & Pierce, P.L.C.

(57) ABSTRACT

A recording sheet processing device includes a stack tray used, when a recording sheet gets jammed inside a subsequent finishing device, for collecting recording sheets left inside a preceding image forming device and recording sheets left inside a recording sheet feeding unit of the image forming device before those recording sheets reach the finishing device. A portion of a conveying path in the recording sheet processing device is opened so that the recording sheet that has jammed at the finishing processing side can freely fall down into a stack tray. Then, a conveying path switching claw is switched to a position for collecting subsequent recording sheets into the stack tray. Thus, subsequent recording sheets are collected in the stack tray without stoppage in conveyance.

10 Claims, 5 Drawing Sheets

RECORDING SHEET PROCESSING DEVICE

CROSS-REFERENCE TO RELATED APPLICATIONS

The present application claims priority to and incorporates by reference the entire contents of Japanese Patent Application No. 2009-014626 filed in Japan on Jan. 26, 2009.

BACKGROUND OF THE INVENTION

1. Field of the Invention

The present invention relates to a recording sheet processing device and particularly relates to a collection mechanism for collecting a recording sheet that gets jammed and recording sheets that follow the jammed recording sheet.

2. Description of the Related Art

In an image forming apparatus such as a copying machine or a printer/printing machine, a toner image formed as a visible image on a latent image carrier such as a photosensitive element is transferred on a recording sheet to obtain a copy of the image.

There are times when an image forming apparatus is equipped with a finishing device that performs stapling or sorting of discharged recording sheets. In such a case, a buffer unit is sometimes disposed between the recording sheet discharging side of the image forming apparatus and the finishing device.

In case a sheet jam occurs, that is, in case a recording sheet gets jammed inside the image forming apparatus including inside the buffer unit or in case a recording sheet gets jammed while being conveyed after getting discharged from the image forming apparatus, then the operations of the apparatus are stopped and the jammed recording sheet is removed by searching the location of the sheet jam.

However, in recent years, configurations have been proposed to prevent the productivity from declining due to the stoppage in operations when a recording sheet gets jammed in the conveying path. In such configurations, it is ensured that a jammed recording sheet gets transferred from the normal conveying path to a separate conveying unit so that the conveyance of the recording sheets fed after the jammed recording sheet is not stopped. Such a conventional technology has been disclosed, for example, in Japanese Patent Application Laid-open No. 2003-95508, Japanese Patent Application Laid-open No. 2005-343661, and Japanese Patent Application Laid-open No. H09-236957.

Japanese Patent Application Laid-open No. 2003-95508 discloses a configuration in which a recording sheet getting jammed inside a buffer is diverged toward a tray from the conveying path leading to a finishing device.

Japanese Patent Application Laid-open No. 2005-343661 discloses a configuration in which a jammed recording sheet is discharged toward an exclusive tray inside a finishing device.

Japanese Patent Application Laid-open No. H09-236957 discloses a configuration in which a recording sheet having an image recorded on one side thereof is re-conveyed to an exclusive sheet feeding tray for the purpose of reusing.

When a recording sheet gets jammed while being conveyed, the conveyance of recording sheets other than the jammed recording sheet is immediately stopped or the other recording sheets are transferred to a specific location.

In such a configuration, the printing operation resumes after the recording sheets other than the jammed recording sheet are also removed. Thus, if the recording sheets remain stagnant at a large number of locations, then the task of removing those recording sheets becomes difficult.

Thus, it is desirable to employ a configuration as disclosed in the abovementioned patent literature in which recording sheets remaining on the conveying path at the time of a sheet jam are transferred to an exclusive tray.

However, if the operations of an apparatus are stopped as described above when a sheet jam occurs at the finishing device side, then the recording sheet that is sandwiched in a stopped conveying member remains in an extended state over a switching claw that is used in switching between conveying directions.

Thus, even if an attempt is made to change the orientation of the switching claw and set it in a position that enables guiding of the subsequent recording sheets to the tray side, the switching claw cannot be moved due to the recording sheet remaining thereover in an extended state.

SUMMARY OF THE INVENTION

It is an object of the present invention to at least partially solve the problems in the conventional technology.

According to an aspect of the present invention, there is provided a recording sheet processing device that is disposed between an image forming device and a finishing device performing finishing processing on a recording sheet discharged from the image forming device, the recording sheet processing device including a stack tray for collecting, when sheet jam occurs where a recording sheet gets jammed inside the finishing device, a recording sheet left inside the image forming device or a recording sheet left inside a recording sheet feeding unit that feeds a recording sheet to the image forming device, so that the recording sheet is not fed to the finishing device. The recording sheet processing device includes a first conveying path leading to the finishing device; a second conveying path leading to the stack tray; a path switching mechanism that switches conveying paths between the first conveying path and the second conveying path; a conveying mechanism that is located in the first conveying path at a downstream side of the path switching mechanism in a recording sheet conveying direction and that sandwiches and conveys a recording sheet when the path switching mechanism has switched the conveying path to the first conveying path; a conveying guide member that is disposed close to the conveying mechanism and that is able to change positions between a first position where the conveying guide member constitutes the first conveying path and a second position where the conveying guide member opens the first conveying path at an opening; and a control unit that controls operations of the path switching mechanism, the conveying mechanism, and the conveying guide member. The control unit, when sheet jam occurs and if a first recording sheet remains over the path switching mechanism, conveys the first recording sheet further so that it passes over the path switching mechanism and reaches up to the conveying mechanism, causes the conveying guide member to be positioned at the second position so that the first recording sheet falls down due to own weight though the opening in the first conveying path and thereby collected in the stack tray, and after a rear end of the first recording sheet has passed over the path switching mechanism due to driving of the conveying mechanism, the path switching mechanism switches the conveying paths to the second path so that a subsequent second recording sheet yet to reach the path switching mechanism is guided to the stack tray.

According to another aspect of the present invention, there is provided a image forming system comprising an image forming device, a finishing device performing finishing processing on a recording sheet discharged from the image forming device and a recording sheet processing device that is disposed between the image forming device and the finishing device. The recording sheet processing device includes a stack tray for collecting, when sheet jam occurs where a recording sheet gets jammed inside the finishing device, a recording sheet left inside the image forming device or a recording sheet left inside a recording sheet feeding unit that feeds a recording sheet to the image forming device, so that the recording sheet is not fed to the finishing device. The recording sheet processing device includes a first conveying path leading to the finishing device; a second conveying path leading to the stack tray; a path switching mechanism that switches conveying paths between the first conveying path and the second conveying path; a conveying mechanism that is located in the first conveying path at a downstream side of the path switching mechanism in a recording sheet conveying direction and that sandwiches and conveys a recording sheet when the path switching mechanism has switched the conveying path to the first conveying path; a conveying guide member that is disposed close to the conveying mechanism and that is able to change positions between a first position where the conveying guide member constitutes the first conveying path and a second position where the conveying guide member opens the first conveying path at an opening; and a control unit that controls operations of the path switching mechanism, the conveying mechanism, and the conveying guide member. The control unit, when sheet jam occurs and if a first recording sheet remains over the path switching mechanism, conveys the first recording sheet further so that it passes over the path switching mechanism and reaches up to the conveying mechanism, causes the conveying guide member to be positioned at the second position so that the first recording sheet falls down due to own weight though the opening in the first conveying path and thereby collected in the stack tray, and after a rear end of the first recording sheet has passed over the path switching mechanism due to driving of the conveying mechanism, the path switching mechanism switches the conveying paths to the second path so that a subsequent second recording sheet yet to reach the path switching mechanism is guided to the stack tray.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
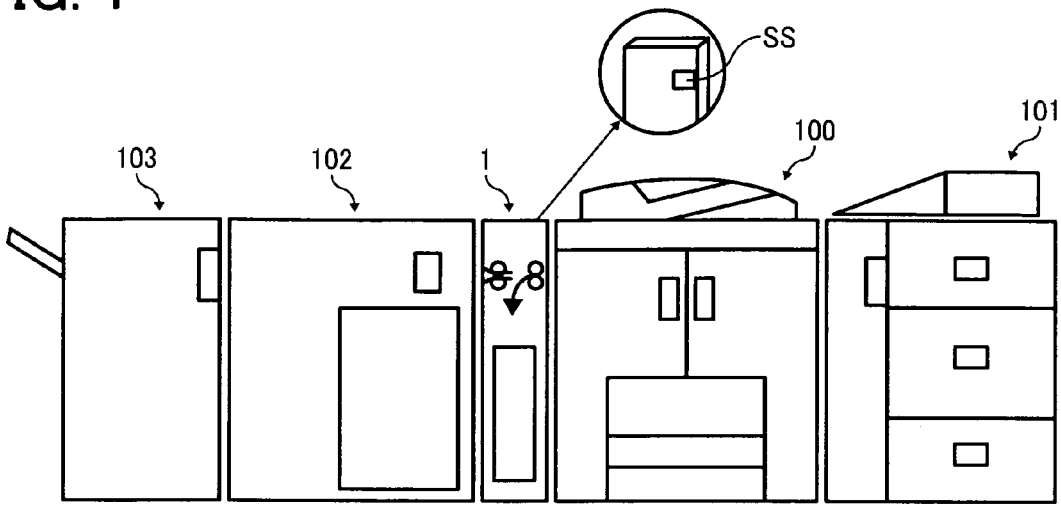
FIG. 1 is a schematic diagram of a system configuration of an image forming apparatus equipped with a recording sheet processing device according to the present invention.

FIG. 1 is a schematic diagram of devices in an image forming system equipped with a recording sheet processing device according to the present invention. The image forming system includes an image forming device 100, a sheet feeding device 101 that functions as a recording sheet supplying unit, and finishing devices including a stacker device 102 and a finisher device 103 that perform finishing processing on recording sheets on which images have been formed. Besides, a recording sheet processing device 1 is disposed between the image forming device 100 and the stacker device 102 of the finishing devices.

If a recording sheet gets jammed at the finishing processing side at which the finishing devices including the stacker device 102 and the finisher device 103 perform finishing processing, then the recording sheet processing device 1 performs sheet jam processing, that is, removes the jammed recording sheet while maintaining the device used in conveying subsequent recording sheets in an operating condition by conveying the recording sheets remaining on the conveying path within the image forming device 100 and the sheet feeding device 101.

Figure 2:
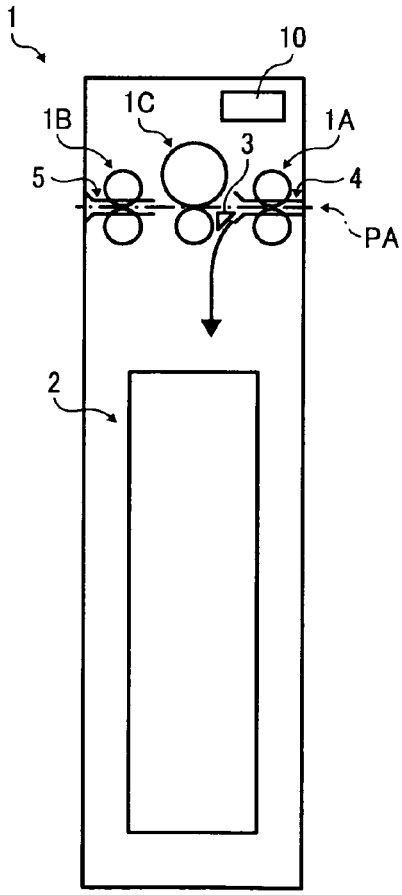
FIG. 2 is a schematic diagram of an essential configuration of the recording sheet processing device according to the present embodiment.

FIG. 2 is a schematic diagram of the internal configuration of the recording sheet processing device 1. In the recording sheet processing device 1 is laid a conveying path PA (illustrated by a dashed-dotted line in FIG. 2) via which the recording sheets discharged from the image forming device 100 are conveyed for finishing processing. On the conveying path PA are disposed a pair of entry rollers 1A that brings in a recording sheet and a pair of exit rollers 1B that conveys that recording sheet for finishing processing. A control unit 10 controls driving of all the parts shown in FIG. 2 such as the entry rollers 1A, the exit rollers 1B, conveying rollers 1C, guide member 5.

On the conveying path PA and between the entry rollers 1A and the exit rollers 1B is disposed a pair of conveying rollers 1C that sandwich and conveys the recording sheet passing over the top surface of a conveying path switching claw 3 described below.

The conveying path switching claw 3 is disposed at the upstream side of the recording sheet conveying direction (arrow direction in FIG. 2) when viewed from the conveying rollers 1C. In the case of occurrence of sheet jam, the conveying path switching claw 3 changes the recording sheet conveying direction toward a stack tray 2, which is located at the lower part inside the recording sheet processing device 1. Meanwhile, the sheet jam mentioned herein is assumed to occur at the finishing processing side.

On the conveying path PA along the recording sheet conveying direction and at the disposed locations of the entry rollers 1A and the exit rollers 1B are respectively disposed conveying guide members 4 and 5.

Figure 3A:
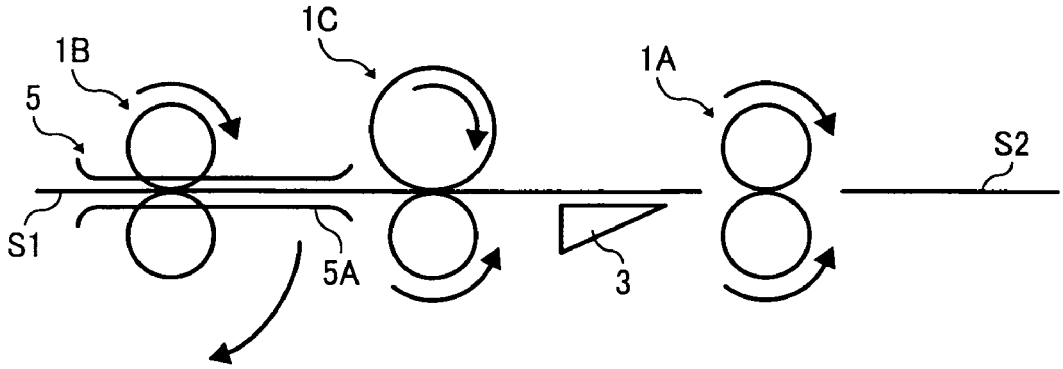
FIGS. 3A and 3B are schematic diagrams for explaining the behavior of the essential configuration of the recording sheet processing device illustrated in FIG. 2.
Figure 3B:
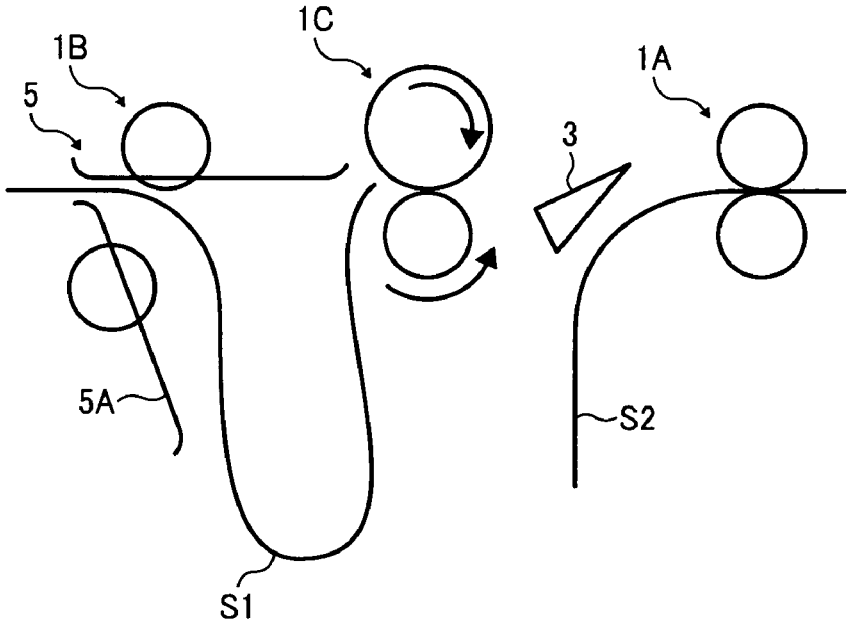

From among the conveying guide members 4 and 5, the conveying guide member 5 that is disposed at the exit rollers 1B includes an opening-closing guide plate 5A residing on the side of the stack tray 2 in, as illustrated in FIGS. 3A and 3B, a position-changeable manner between a position at which the conveying guide member 5 and one of the rollers in the exit rollers 1B constitute the conveying path PA and a position attained by rotating toward the stack tray 2 so that the conveying path PA is opened.

More particularly, as illustrated in FIGS. 3A and 3B, the opening-closing guide plate 5A is disposed in a position-changeable manner between the position of constituting the conveying path PA (see FIG. 3A) and the position toward the downward direction. A configuration enabling the position changing is illustrated in FIG. 4.

Figure 4:
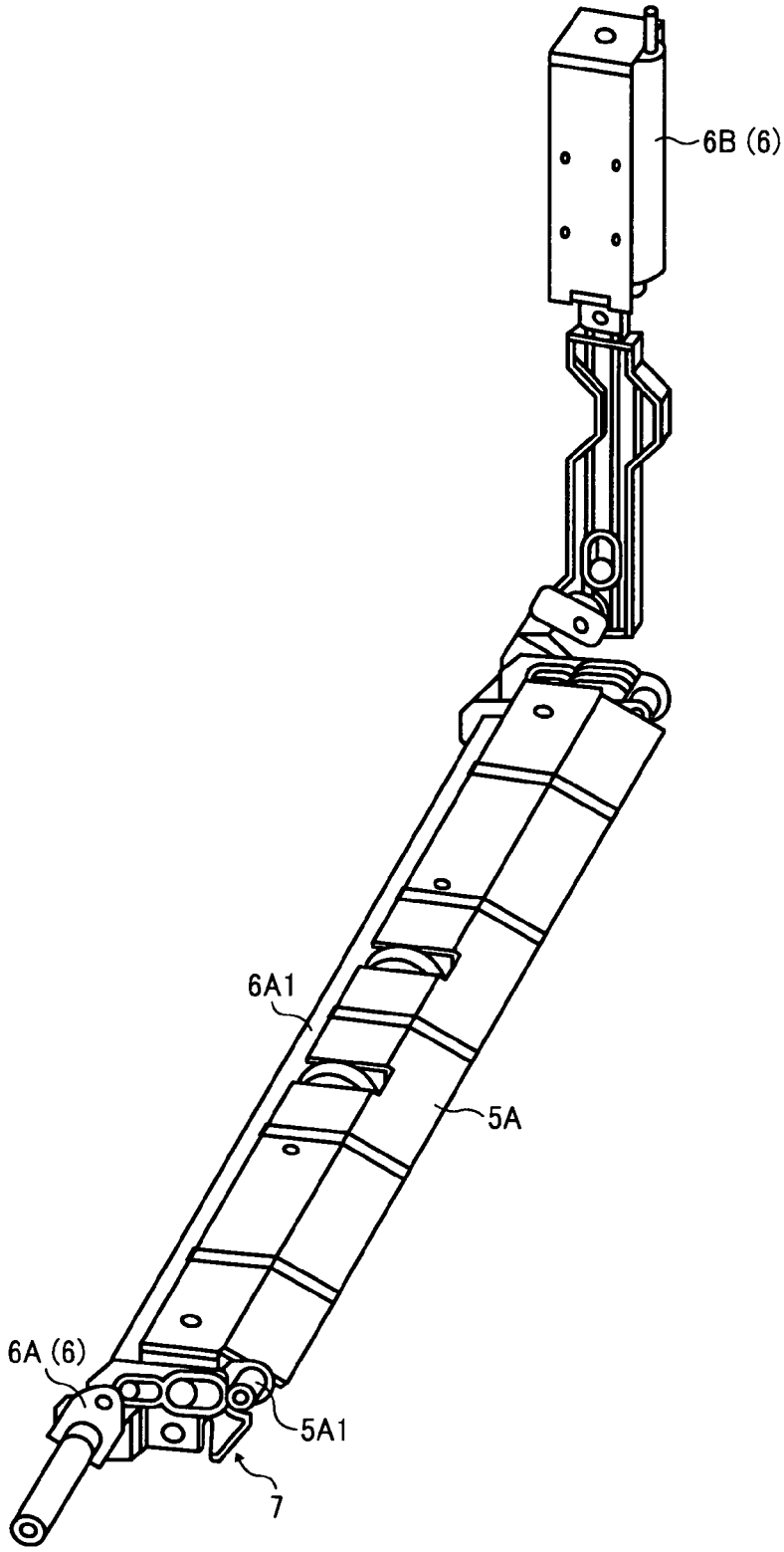
FIG. 4 is a schematic diagram of an opening-closing driving mechanism used in the recording sheet processing device illustrated in FIG. 2.

As illustrated in FIG. 4, the base end of the opening-closing guide plate 5A is pivotably supported by a crankshaft 6A1, which is the spindle of a crank 6A fitted in an opening-closing driving mechanism 6 described later. At the rotating end (oscillating end) of the opening-closing guide plate 5A is disposed a stud 5A1 having the axial direction along the recording sheet width direction that is perpendicular to the recording sheet conveying direction.

The opening-closing driving mechanism 6 includes the crank 6A and a solenoid 6B that oscillatably drives the crank 6A. In the solenoid 6B is disposed a crank (not illustrated) that converts the reciprocating motion of an actuator into rotation of the crankshaft 6A1.

The opening-closing driving mechanism 6 also includes a slide claw 7 that is used for locking the stud 5A1 of the opening-closing guide plate 5A and releasing the stud 5A1 from the locked state.

Figure 5:
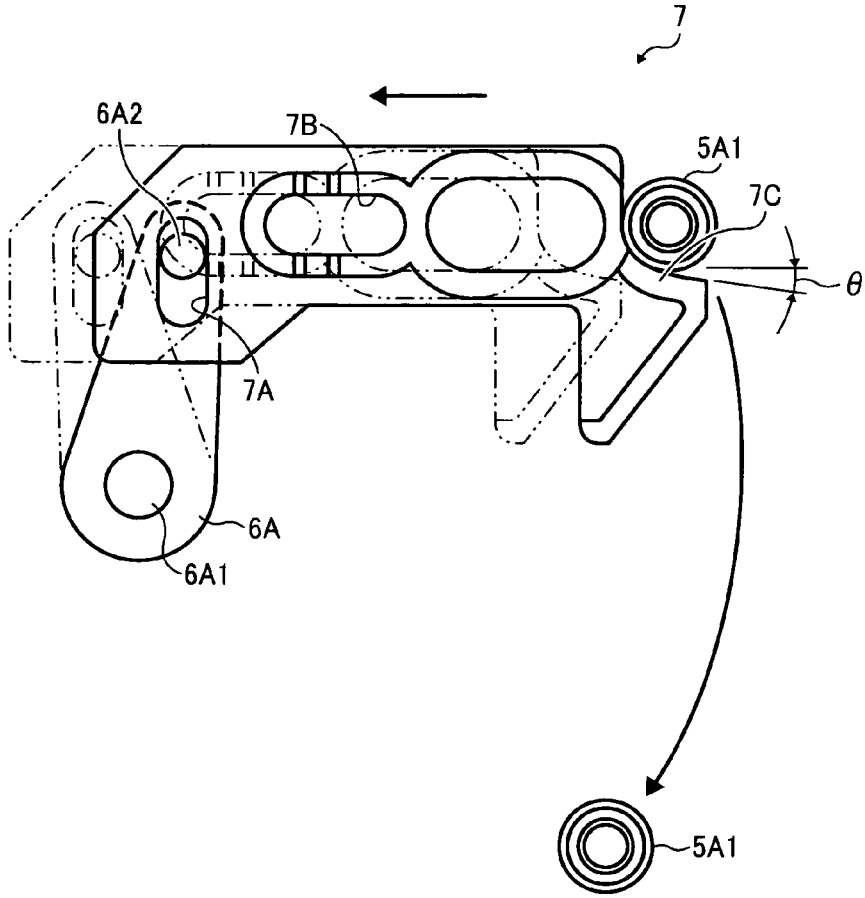
FIG. 5 is a schematic diagram of a configuration of a slide claw disposed in the opening-closing driving mechanism illustrated in FIG. 4.

FIG. 5 is a schematic diagram of the slide claw 7 disposed in the opening-closing driving mechanism 6. As illustrated in FIG. 5, the slide claw 7 includes a vertical driving hole 7A in which fits a pin 6A2 that is disposed at the rotating end of the crank 6A, a guide hole 7B formed in horizontal direction, and a locking unit 7C that is formed at the opposite end to the vertical hole and that locks the stud 5A1.

The slide claw 7 is configured to perform a reciprocating motion in response to the rotation of the crank 6A. The initial position of the reciprocating motion is considered to be that position of the slide claw 7 at which the stud 5A1 rests on the locking unit 7C thereby locking the rotation of the opening-closing guide plate 5A. In conjunction with the rotation of the crank 6A, the slide claw 7 moves from the initial position to a position away from the stud 5A1 so that the stud 5A1 is released from the locked state.

When the stud 5A1 is released from the locked state, the opening-closing guide plate 5A is able to rotate toward the stack tray 2 using its own weight with the crankshaft 6A1 as the fulcrum point.

For that reason, when the conveying path PA is opened, the recording sheet (referred to as S1 in FIG. 6) at the finishing processing side can freely fall down into the stack tray 2 because no guiding portion is present once the rear end of the recording sheet rolls through the conveying rollers 1C.

In the slide claw 7, the resting surface of the locking unit 7C on which the stud 5A1 rests is configured to be a tapered surface having a gradient toward the stack tray 2 (having an angle θ as illustrated in FIG. 5) with respect to the horizontal direction.

Figure 6:
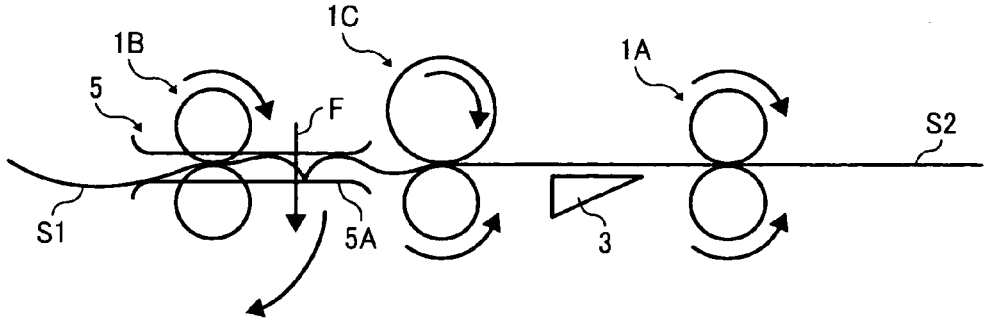
FIG. 6 is a schematic diagram for explaining an effect on the slide claw caused when a recording sheet gets jammed during finishing processing.

As illustrated in FIG. 6, when a sheet jam occurs at the finishing processing side, the force generated due to crumpling of the recording sheet (force in the direction of an arrow F in FIG. 6) acts on the opening-closing guide plate 5A. If that force acts as a pressing force on the slide claw 7, then that causes resistance to the horizontal movement of the slide claw 7. Thus, to guard against immobility of the slide claw 7, the locking unit 7C of the slide claw 7 is configured to have a tapered surface.

That is, by configuring the resting surface for the stud 5A1 to be a tapered surface, when the downward force acting on the opening-closing guide plate 5A (force in the direction of the arrow F in FIG. 6) acts on the tapered surface, the gradient of the tapered surface generates a force component in the horizontal direction. That makes it easier for the slide claw 7 to move in the horizontal direction.

Since such a configuration eliminates the need to increase the driving force of the solenoid 6B, it becomes possible to prevent an inadvertent increase in the power consumed for the driving purpose.

Meanwhile, as illustrated in FIGS. 3A and 3B, when the recording sheet S1 gets jammed at the finishing processing side, the conveying path switching claw 3 is able to perform the oscillating motion as soon as the rear end of the recording sheet S1 jammed at the finishing processing side rolls through the top surface of the conveying rollers 10. In other words, the conveying path switching claw 3 cannot perform the oscillating motion as long as the recording sheet S1 remains in an extended state. Thus, only when no load is caused due to the extended state of the recording sheet S1, the conveying path switching claw 3 is able to perform the oscillating motion.

Once the conveying path switching claw 3 performs the oscillating motion, the position thereof can be changed so that the conveying direction of a recording sheet S2, which is fed into the recording sheet processing device 1 following the recording sheet S1, changes toward the stack tray 2. The configuration to make that possible is described below.

Figure 7:
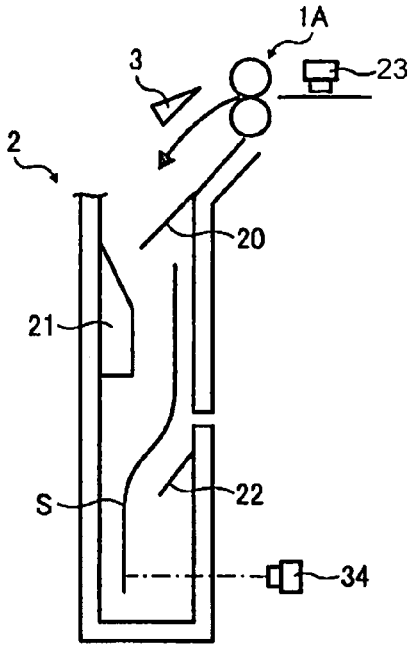
FIG. 7 is a schematic diagram of a configuration of a stack tray disposed in the recording sheet processing device illustrated in FIG. 2.
Figure 8:
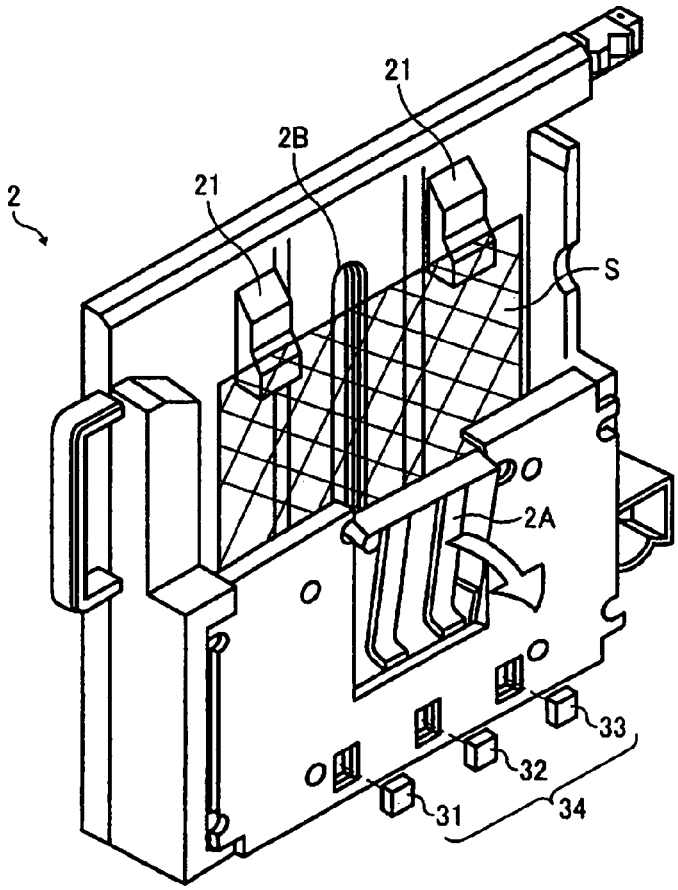
FIG. 8 is an external view of the stack tray illustrated in FIG. 7.

As shown in FIGS. 7 and 8, a sensor 23 for detecting the conveyance of the recording sheet S1 toward the finishing processing side is disposed close to the conveying rollers 1A. As soon as the sensor 23 detects that the rear end of the recording sheet S has passed over the conveying path switching claw 3, the conveying path switching claw 3 switches the conveying path. The control unit 10 receives signals from the sensor 23 and determines whether there is sheet jam.

Although not shown in FIGS. 3A and 3B, in addition to the sensor 23 disposed close to the conveying rollers 1A, sensors for detecting the recording sheet conveyance are disposed at a plurality of locations on the conveying path PA. Whether a recording sheet has got jammed can be determined by finding out the conveyance time taken by that recording sheet for passing between the sensors.

When a sheet jam is detected to have occurred by the sensor 23 and when recording sheets are guided to the stack tray 2 of the recording sheet processing device 1, and detected by sensors 34 shown in FIG. 7, a warning about the same is given using a warning unit SS (see FIG. 1) that is disposed at a portion on the outer wall surface of the recording sheet processing device 1 and that includes a lighting unit such as a light emitting diode (LED). As shown in FIG. 8, the sensor 34 includes three sensors 31, 32, and 33; however, the number of sensors is not limited to three.

Given below is the description with reference to FIG. 7 about a configuration of the stack tray 2 disposed inside the recording sheet processing device 1.

FIG. 7 is a schematic diagram of a configuration of the stack tray 2. As illustrated in FIG. 7, the stack tray 2 is an open-topped housing with the top portion kept open as a recording sheet entering portion through which the recording sheets enter vertically into the housing.

On a portion of a wall surface of the stack tray 2 that faces the vertically-entering recording sheets is disposed a small guide cover 2A in an openable-closable manner as can be seen in FIG. 8. The small guide cover 2A can be opened toward outside to take out small-size recording sheets collected inside the stack tray 2.

Besides, as a recording-sheet removal assisting member, a long hole 2B having vertical longitudinal direction is formed on the wall surface opposite to the small guide cover 2A as can be seen in FIG. 8. The long hole 2B is formed in such a way that it is possible to insert fingers from outside and grab the recording sheets collected in the stack tray 2. Moreover, the collected recording sheets can be confirmed from outside through the long hole 2B.

Inside the stack tray 2 is disposed a posture correcting unit for the vertically-entering recording sheets so that the rear end of the entering recording sheets is unidirectionally guided. Thus, at the rear end side of the recording sheets entering the stack tray 2, that is, at the recording sheet entry side of the stack tray 2, the recording sheets are sequentially and unidirectionally guided for collection. The configuration of the posture correcting unit is given below.

As illustrated in FIG. 7, a guide sheet 20 is disposed at a position close to the surface at the recording sheet entry side that is kept open in the stack tray 2. The guide sheet 20 regulates the orientation of the recording sheets guided by the entry rollers 1A. The guide sheet 20 directs the orientation of each recording sheet toward a stack surface tilt platform 21 that is disposed on the wall surface opposite to the guide sheet 20.

The stack surface tilt platform 21 has an inclined surface extending inward from the wall surface opposite to the wall surface on which the guide sheet 20 is disposed. The recording sheet falling along the inclined surface toward the bottom surface of the stack tray 2 is pushed at the rear end toward the wall surface on the opposite side due to that inclined surface.

In addition, at the lower part side of the stack tray 2 and on the wall surface at the same side of the guide sheet 20 is disposed a guide plate tilt platform 22, which has the same inclined direction to that of the guide sheet 20.

Thus, a recording sheet S entering the stack tray 2 is pushed toward the stack surface tilt platform 21 while the rear end thereof is made to fall toward the side of the guide sheet 20. Then, just before reaching the bottom surface of the stack tray 2, the recording sheet S is pushed at the guide plate tilt platform 22 toward the opposite direction than the previously pushed direction and the rear end thereof is pushed at the stack surface tilt platform 21 so that the rear end falls toward the side of the guide sheet 20. In this way, the recording sheet S is collected in a posture in which the rear end thereof is guided to the side of the guide sheet 20.

Thus, in the vicinity of the surface at the recording sheet entry side that is kept open in the stack tray 2, the recording sheet is collected in a unidirectionally guided posture. Because of that, the entry of a subsequent recording sheet from the recording sheet entry side is prevented from being blocked due to collision.

For the abovementioned configuration according to the present embodiment, the behavior is described below with reference to FIGS. 3A and 3B.

In FIG. 3A is illustrated a normal conveyance condition with no occurrence of a sheet jam. In that condition, the conveying guide member 5 is set in the position constituting the conveying path PA. Thus, the recording sheets fed into the recording sheet processing device 1 are conveyed over the top surface of the conveying path switching claw 3 toward the finishing processing side.

On the other hand, in FIG. 3B is illustrated a condition in which a sheet jam occurs at the finishing processing side. In that condition, the opening-closing guide plate 5A constituting one side of the conveying guide member 5 changes position so that the conveying path PA is opened.

To enable the position changing, the crank 6A is rotated via the excitation of the solenoid 6B in the opening-closing driving mechanism 6 and the slide claw 7 moves in the horizontal direction in conjunction with the rotation of the crank 6A. Thus, when the slide claw 7 moves in the horizontal direction, the stud 5A1 that is disposed in the opening-closing guide plate 5A and that is locked to the locking unit 7C as illustrated in FIG. 5 moves away from the locking unit 7C and is released from the locked state.

Consequently, the opening-closing guide plate 5A constituting one side of the conveying guide member 5 rotates to change position toward the stack tray 2 using its own weight.

When driving of the conveying rollers 1C is continued in synchronization with the position changing of the conveying guide member 5, the recording sheet with the front end thereof halted due to jamming has its rear end pushed by the conveying rollers 1C. At that time, since the conveying path at the rear end of the recording sheet is opened, a downward slack is formed in the pushed recording sheet so that it can fall toward the stack tray 2 from the slacked portion due to its own weight. In this way, the recording sheet causing a sheet jam can be removed.

Meanwhile, when it is detected by a sensor that the jammed recording sheet S1 has rolled through the conveying rollers 1C, the position of the conveying path switching claw 3 is changed so that the conveying direction of the subsequent recording sheet S2 changes toward the stack tray 2. Thus, the recording sheet S2 is collected in the stack tray 2 without any stoppage in its conveyance.

When a recording sheet is being collected in the stack tray 2, it is indicated to the outside using the warning unit SS (see FIG. 1).

As described with reference to FIG. 7, the recording sheets collected in the stack tray 2 reside with the rear end thereof guided unidirectionally so that the entry of subsequent recording sheets is not blocked.

The presence of recording sheets collected in the stack tray 2 can be confirmed from outside through the long hole 2B (see FIG. 8) formed on a wall of the stack tray. Besides, when small-size recording sheets are confirmed to have been collected in the stack tray 2, then the small guide cover 2A (see FIG. 8) can be opened to remove those recording sheets.

As described above, when it is detected by a sensor that the jammed recording sheet S1 has rolled through the conveying rollers 10, the position of the conveying path switching claw 3 is changed so that the conveying direction of the subsequent recording sheet S2 changes toward the stack tray 2. Thus, the recording sheet S2 is collected in the stack tray 2 without any stoppage in its conveyance. As a result, the recording sheets under conveyance in the image forming device 100 and the sheet feeding device 101 are collected in the stack tray 2. That eliminates the need to remove the recording sheets under conveyance.

According to an aspect of the present invention, if a sheet jam occurs, then, while continuing driving of a conveying member, a conveying guide member is switched to a position of opening the conveying path. Then, as soon as the rear end of a recording sheet conveyed by the conveying member rolls over a conveying path switching claw, the recording sheet falls in a stack tray due to its own weight from an open portion of the conveying path. Because of that, the conveying path switching claw becomes movable. Consequently, the movable conveying path switching claw can be used in collecting subsequent recording sheets in the stack tray without any stoppage in conveyance.

For that reason, even if a recording sheet remains over the conveying path switching claw, it becomes possible to make the conveying path switching claw movable and collect the jammed recording sheet as well as the subsequent recording sheets. As a result, the task of collecting the recording sheets that have stopped during conveyance is prevented from becoming cumbersome.

According to another aspect of the present invention, a recording sheet removing unit is disposed in the stack tray for removing recording sheets collected in the stack tray. The recording sheet removing unit assists the task of removing recording sheets at a location other than the entry location. Moreover, the recording sheet removing unit can also be used to confirm whether recording sheets are collected in the stack tray. Thus, it can be easily determined whether removing of recording sheets from the stack tray is necessary.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A recording sheet processing device that is disposed between an image forming device and a finishing device performing finishing processing on a recording sheet discharged from the image forming device, the recording sheet processing device including a stack tray for collecting, when sheet jam occurs where a recording sheet gets jammed inside the finishing device, a recording sheet left inside the image forming device or a recording sheet left inside a recording sheet feeding unit that feeds a recording sheet to the image forming device, so that the recording sheet is not fed to the finishing device, the recording sheet processing device comprising:

a first conveying path leading to the finishing device;

a second conveying path leading to the stack tray;

a path switching mechanism that switches conveying paths between the first conveying path and the second conveying path;

a conveying mechanism that is located in the first conveying path at a downstream side of the path switching mechanism in a recording sheet conveying direction and that sandwiches and conveys a recording sheet when the path switching mechanism has switched the conveying path to the first conveying path;

a conveying guide member that is disposed close to the conveying mechanism and that is configured to change positions between a first position where the conveying guide member constitutes part of the first conveying path and a second position where the conveying guide member opens the first conveying path at an opening; and a control unit that controls operations of the path switching mechanism, the conveying mechanism, and the conveying guide member, wherein the control unit when sheet jam occurs and if a first recording sheet remains over the path switching mechanism, conveys the first recording sheet further so that it passes over the path switching mechanism and reaches up to the conveying mechanism, causes the conveying guide member to be positioned at the second position so that the first recording sheet falls down due to own weight through the opening in the first conveying path and thereby collected in the stack tray, and after a rear end of the first recording sheet has passed over the path switching mechanism due to driving of the conveying mechanism, causes the path switching mechanism to switch the conveying path to the second path so that a subsequent second recording sheet yet to reach the path switching mechanism is guided to the stack tray.

2. The recording sheet processing device according to claim 1, wherein the stack tray is disposed beneath the conveying guide member, and the conveying guide member is configured to be rotatable toward the stack tray and to be able to change position to a position at which a slack toward the stack tray forms in a recording sheet remaining over the path switching mechanism and, when a rear end of the recording sheet leaves the conveying mechanism, the recording sheet falls in the stack tray due to own weight.

3. The recording sheet processing device according to claim 2, wherein the conveying guide member includes opening-closing guide plates that are disposed facing each other across the first conveying path, one of the opening-closing guide plates being oscillatable from a position of facing the first conveying path toward the stack tray, a stud disposed at an oscillating end of the one of the opening-closing guide plates having a locked position and a lock-released position set with respect to an opening-closing driving mechanism disposed close to an opening-closing conveying member, the one of the opening-closing guide plates oscillating toward the stack tray due to own weight when the stud is set to the lock-released position.

4. The recording sheet processing device according to claim 3, wherein the opening-closing driving mechanism includes a claw unit that is able to lock the stud and is movable to a position for making the conveying guide member face the first conveying path and to a position for making the conveying guide member oscillate toward the stack tray, and that, while making the conveying guide member oscillate toward the stack tray, moves in a direction of releasing the stud from a locked state.

5. The recording sheet processing device according to claim 4, wherein a surface of the claw unit in the opening-closing driving mechanism on which the stud is locked is a tapered surface.

6. The recording sheet processing device according to claim 1, wherein the stack tray includes a recording-sheet removal assisting unit that is disposed on a portion of a wall section for housing a recording sheet and through which fingers are insertable.

7. The recording sheet processing device according to claim 1, wherein the stack tray is configured from a housing enabling vertical entry of a recording sheet and a portion of a wall section facing a vertical surface of the recording sheet that has entered the housing is configured to be openable-closable.

8. The recording sheet processing device according to claim 1, further comprising:

a plurality of sensors disposed between a conveying path up to the stack tray and up to the path switching mechanism for detecting occurrence of sheet jam based on a recording sheet conveyance time in the conveying path; and a warning unit configured to give warning when the sensors detect sheet jam and when a recording sheet is collected in the stack tray.

9. The recording sheet processing device according to claim 1, wherein the stack tray includes a posture correcting unit for unidirectionally guiding a rear end side of a recording sheet vertically entering the stack tray so that a recording sheet that passes the posture correcting unit has the rear end thereof guided unidirectionally to a position of not blocking an entry of a subsequent recording sheet.

10. An image forming system comprising an image forming device, a finishing device performing finishing processing on a recording sheet discharged from the image forming device and a recording sheet processing device that is disposed between the image forming device and the finishing device, the recording sheet processing device including a stack tray for collecting, when sheet jam occurs where a recording sheet gets jammed inside the finishing device, a recording sheet left inside the image forming device or a recording sheet left inside a recording sheet feeding unit that feeds a recording sheet to the image forming device, so that the recording sheet is not fed to the finishing device, the recording sheet processing device comprising:

a first conveying path leading to the finishing device;

a second conveying path leading to the stack tray;

a path switching mechanism that switches conveying paths between the first conveying path and the second conveying path;

a conveying mechanism that is located in the first conveying path at a downstream side of the path switching mechanism in a recording sheet conveying direction and that sandwiches and conveys a recording sheet when the path switching mechanism has switched the conveying path to the first conveying path;

a conveying guide member that is disposed close to the conveying mechanism and that is configured to change positions between a first position where the conveying guide member constitutes part of the first conveying path and a second position where the conveying guide member opens the first conveying path at an opening; and a control unit that controls operations of the path switching mechanism, the conveying mechanism, and the conveying guide member, wherein the control unit when sheet jam occurs and if a first recording sheet remains over the path switching mechanism, conveys the first recording sheet further so that it passes over the path switching mechanism and reaches up to the conveying mechanism, causes the conveying guide member to be positioned at the second position so that the first recording sheet falls down due to own weight through the opening in the first conveying path and thereby collected in the stack tray, and after a rear end of the first recording sheet has passed over the path switching mechanism due to driving of the conveying mechanism, causes the path switching mechanism to switch the conveying path to the second path so that a subsequent second recording sheet yet to reach the path switching mechanism is guided to the stack tray.

* * * * *